US011992097B1

(12) United States Patent
Wagner

(10) Patent No.: US 11,992,097 B1
(45) Date of Patent: May 28, 2024

(54) MULTI-PLATFORM ATTACHMENT SYSTEM

(71) Applicant: Brian K. Wagner, Puyallup, WA (US)

(72) Inventor: Brian K. Wagner, Puyallup, WA (US)

( * ) Notice: Subject to any disclaimer, the term of this patent is extended or adjusted under 35 U.S.C. 154(b) by 179 days.

(21) Appl. No.: 17/735,794

(22) Filed: May 3, 2022

(51) Int. Cl.
*A44B 11/25* (2006.01)
*A45F 5/02* (2006.01)

(52) U.S. Cl.
CPC ..... *A44B 11/258* (2013.01); *A45F 5/021* (2013.01)

(58) Field of Classification Search
CPC ..... A44B 11/258; A45F 5/021; A45F 5/02; Y10T 24/1394
See application file for complete search history.

(56) References Cited

U.S. PATENT DOCUMENTS 5,724,707 A 3/1998 Kirk et al.
6,145,169 A 11/2000 Terzuola et al.
7,025,238 B2 4/2006 Hughes et al.
8,297,562 B1 * 10/2012 Yeates ..... F41C 33/045 248/222.51
8,458,867 B2 * 6/2013 Rogers ..... A45F 5/02 24/3.12
8,523,029 B2 * 9/2013 Rogers ..... F41C 33/045 224/675
9,027,212 B2 * 5/2015 Wu ..... G03B 17/561 24/3.12
9,480,328 B2 * 11/2016 Stevens ..... A45F 5/021
11,530,897 B2 * 12/2022 Smith ..... A45F 5/02
2011/0036880 A1 * 2/2011 Lee ..... A45F 5/02 224/269

(Continued)

OTHER PUBLICATIONS

YCYU 2 Pack Knife Clip Holster Tactical Belt (Aug. 31, 2017) https://www.amazon.com/YCYU-Holster-Tactical-Universal-Utility/dp/B08NT3FZQ8/ref=sr_1_7?crid=GUZ3E2CPLBA0&keywords=combat+loop&qid=1652214944&sprefix=combat+%2Caps%2C429&sr=8-7 (1 page).

(Continued)

*Primary Examiner* — Robert Sandy
*Assistant Examiner* — Louis A Mercado
(74) *Attorney, Agent, or Firm* — R. Reams Goodloe, Jr.

(57) ABSTRACT

A clip piece. Two clip pieces are joined to provide a clip assembly which is used to attach an object to user equipment. Clip pieces include a support bar from which prongs extend. Two outer prongs and at least one central prong are provided. The at least one central prong is spaced apart from and located between the first outer prong and the second outer prong. The first outer prong, the second outer prong, and the at least one central prong each have a proximal end located at the support bar. Each of the first outer prong, the second outer prong, and the at least one central prong extend longitudinally from the proximal end to a distal end. A latch keep portion is provided, having first latch keep aperture defined by first latch keep inner sidewalls, and a second latch keep aperture defined by second latch keep inner sidewalls. A first latch is located adjacent the distal end of the first outer prong, and sized and shaped for interfitting releasable engagement with the first latch keep aperture. A second latch is similarly provided. The outer prongs are flexible, and can be urged toward the central prong, for release of latches.

36 Claims, 10 Drawing Sheets

(56) References Cited

U.S. PATENT DOCUMENTS

| | | | | |
|---|---|---|---|---|
| 2012/0174341 | A1* | 7/2012 | Rogers | F41C 33/041 24/3.1 |
| 2012/0175391 | A1* | 7/2012 | Rogers | A45F 5/02 224/191 |
| 2015/0342283 | A1* | 12/2015 | Lebel | A42B 3/185 24/3.1 |
| 2016/0037899 | A1 | 2/2016 | Stevens | |

OTHER PUBLICATIONS

Blade Tech Molle Lok (Feb. 19, 2020) https://blade-tech.com/products/molle-lok (2 pages).
Fight Light Malice Clips Bulk (Jul. 9, 2016) https://www.tacticaltailor.com/fightlightmaliceclipsbulk.aspx (2 pages).
Cytac Belt Loop Clip Compatible with T-Thumbsmart Series (Apr. 9, 2018) https://www.cytac.com/products/belt-clip/ (1 page).
Guns & Flower Holster Belt Adapter (Nov. 13, 2021) https://www.gunflower.net/products/detail/gun-flower-holster-belt-adapter.html (1 page).
Guns & Flower Molle Adapter (Jul. 12, 2021) https://www.amazon.com/dp/B0995LB29X?tag=dzonsaharvarda-20&linkCode=osi&th=1&keywords=molle+clips&psc=1 (1 page).
DYZD Multipurpose Molle Clip (Feb. 14, 2017) https://www.amazon.com/DYZD-Multipurpose-Attachments-Dominator-Tactical/dp/B06W55CC81 (1 pages).
Tactical Tailer—Sort Malice Clip W/Mounting Hardware For Molle Attachment (Jun. 24, 2017) https://www.amazon.com/dp/B014LCXGJE?tag=dzonsaharvarda-20&linkCode=osi&th=1&psc=1&keywords=molle%20clips (1 page).
Grimloc (locking D-ring) (Oct. 12, 2014) https://milspecmonkey.com/store/hardware-diy/125-itw-grimloc.html (1 page).
Blackhawk Speed Clips (Sep. 1, 2004) https://www.amazon.com/BLACKHAWK-Speed-Clips-6-Pack-Black/dp/B001EC3SMU/ref=sr_1_78?crid=12JQOSI9VCLAA&keywords=tactical+belt+and+molle%2FPals+clips&qid=1652212776&sprefix=tactical+belt+and+molle%2Fpals+clip%2Caps%2C172&sr-8-78 (1 page).
Coyote Brown 2 Part Tan Every Which Way Buckle System Military Tactical T-Ring Adaoptor for Molle Pals Tring (Mar. 18, 2014) https://www.amazon.com/Buckle-System-Military-Tactical-Adaptor/dp/B00J3H1P3W/ref=sr_1_104?crid=12JQOSI9VCLAA&keywords=tactical+belt+and+molle%2FPals+clips&qid=1652212971&sprefix=tactical+belt +and+molle%2Fpals+clip%2Caps%2C172&sr-8-104 (1 page).
Safariland Tactical Molle Adapter (Sep. 1, 2004) https://www.amazon.com/s?k=tactical+belt+and+molle%2FPals+clips&page=3&crid=12JQOSI9VCLAA&qid=1652212928&sprefix=tactical+belt+and+molle%2Fpals+clip%2Caps%2C172&ref=sr_pg_3 (1 page).
Safariland Quick Locking System Kit (Apr. 30, 2009) https://safariland.com/collections/holster-attachments/products/quick-locking-system-kit-23136 (1 page).
Blade-Tech The Original Tek-Lok Belt Attachment / Clip for Holsters, Mag Pouches, and More (Mar. 25, 2019) https://www.amazon.com/Blade-Tech-Original-Tek-Lok-Attachment-Holsters/dp/B07PZCX8P8 (1 page).
Cytac 360 Belt Clip Quick Adjust Belt Loop (Aug. 17, 2015) https://www.cytac.com/products/belt-clip (1 page).
Cytac Molle (Aug. 17, 2015) https://www.cytac.com/products/belt-clip (1 page).

* cited by examiner

MULTI-PLATFORM ATTACHMENT SYSTEM

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

RELATED PATENT APPLICATIONS

None.

TECHNICAL FIELD

This disclosure relates to attachment systems in the form of clips for use in detachably securing objects such as weapons or phones to a belt or other objects worn or carried by a user.

BACKGROUND

A continuing interest and need exists for improvements to clips that can be used for attachment of objects worn or carried by a user. More particularly, a need exists for an attachment system in which objects could be securely attached to a user, where the attachment system is designed for detachment in case the object being carried must be relocated or becomes entangled in a manner that might hinder the movement of the user carrying the object.

One typical prior art attachment system is seen in U.S. Pat. No. 6,145,169, issued Nov. 14, 2000, to Terzuola et al., entitled Locking, Removable Belt Clip. That patent describes a belt clip for securing an object to a user's belt, and utilizes a design in which has two portions joined by a hinge, wherein the belt clip is secured to belt by opening up the clip at the hinge, positioning the portions around a belt, and then closing the hinge until a locking mechanism snaps into place. Unfortunately, that design tends to hinder any breakaway opening at the hinges, especially when force is applied along or near to the centerline of the hinged structure, and thus a user may continue to be hung up to an object attached by that belt clip design. Such a design may prove unsafe or even life threatening, in various situations.

Thus, availability of an attachment clip design that would better enable the breakaway functionality, especially when lateral loads are applied, would provide a significant improvement by facilitating separation of components.

Consequently, a technical problem remains, namely the need to provide an improved design for attachment clips, in order to provide better and more reliable separation of components to enable a user to become free of a carried object which has become entangled, or when that object must be relocated on a "load bearing platform" (such as a belt or backpack). Moreover, it would be advantageous if such a design simultaneously resolves various practical problems, including (a) minimizing the necessity to provide numerous parts for construction and repair, and thus minimize the cost of an attachment clip assembly and/or replacement parts, (b) providing easily utilized additional components to provide adjustable features, for example, components which make use with belts of different heights easily feasible, than is the case in most currently available attachment clip designs, and (c) providing a clip/attachment system that can be moved readily between a belt and a cloth/webbing based platform such as a vest or backpack. In summary, there remains a need for an improved attachment system for attachment of an object to a user's belt or other object, and which improves safety by enabling reliable breakaway performance, especially in the case of side loading, and thus enhances safe operation and improved survivability.

Some Objects, Advantages, and Novel Features

Accordingly, one objective of my invention is to provide an attachment clip assembly which is simple, straightforward, and which is sized and shaped to easily be utilized with a variety of belt sizes or cloth/webbing based platforms.

Another objective of my invention is to provide a design in which the number of unique parts and components is minimized, to avoid the need for fasteners or factory assembly prior to sale.

A related and important objective is to provide an attachment clip assembly in which the primary components are identical, so that the manufacture or assembly of different structures for interior and exterior portions is avoided.

SUMMARY

A novel clip piece is provided. And, a clip assembly, formed from the use of two clip pieces in a face-to-face configuration, is provided. In an embodiment, the clip pieces used in the clip assembly may be identical. In an embodiment, a clip piece may include a support bar, where the support bar has an inner face, an outer face, and a body between the inner face and the outer face. The body extends laterally between a first end and a second end. The clip piece includes a first outer prong, a second outer prong, and at least one central prong, each of which extend away from the support bar. The at least one central prong is spaced apart from and located between the first outer prong and the second outer prong. The first outer prong, the second outer prong, and the at least one central prong each have a proximal end located at the support bar. Each of the first outer prong, the second outer prong, and the at least one central prong extend longitudinally from the proximal end to a distal end.

At a first end of the clip piece, a latch keep portion is provided. In an embodiment, the latch keep portion may extend from the outer face of the support bar. The latch keep portion further includes a first latch keep aperture defined by first latch keep inner sidewalls, and a second latch keep aperture defined by second latch keep inner sidewalls. The first latch keep aperture and the second latch keep aperture are laterally spaced apart. The lateral spacing between such latch keep apertures is configured for latching engagement of a first latch on a first outer prong of a second clip portion with a first latch aperture on a first clip portion, and with latching engagement of a second latch keep aperture with a second latch on a second outer prong of a second clip portion. More simply, each clip portion has at least two latches, and each clip portion has at least two latch keep apertures having a latching ledge therein, and when two clip pieces are brought together, the two latches securely mate with a latching ledge in the latch keep apertures of the opposing clip portion. Thus, the clip portions are designed for interfitting secure but releasable engagement with other clip portions.

In an embodiment, the first outer prong and the second outer prong are flexible so that the distal end of the first outer prong and the distal end of the second outer prong can each be urged toward the at least one central prong. In this manner, a first latch at or near the distal end of the first outer prong, and a second latch at or near the distal end of the second outer prong, may be urged laterally toward the at least one central prong, so that the latches move sufficiently for entry into the latch keep apertures of an opposing clip portion, but return to an original position when compressive force on the first outer prong and on the second outer prong are released. In an embodiment, the first outer prong has a first inside surface, and the first latch protrudes outwardly away from the first inside surface, and inwardly with respect to a clip assembly. In an embodiment, the second outer prong has a second inside surface, and the second latch protrudes away from the second inside surface, and inwardly with respect to a clip assembly. In an embodiment, the first latch and the second latch may be provided as a J-shaped structure having a hooked end, and where the hooked end is open in a direction laterally away from the at least one central prong.

In an embodiment, for securing objects to a clip assembly made up of a pair of joined clip portions in a secure, releasable, face-to-face configuration, the first outer prong may include one or more apertures therein, each defined by aperture sidewalls. Similarly, the second outer prong may further include, between its proximal end and its distal end, one or more apertures therein, each defined by aperture sidewalls. Likewise, in an embodiment, the at least one central prong may further include, between its proximal end and its distal end, one or more apertures therein, each defined by aperture sidewalls. The just described apertures enable a user to attach or affix objects to the clip assembly, such as by using strong cord, or by a selected attachment device or fastener.

In an embodiment, a first clip piece and a second clip piece may both be manufactured in an elastic synthetic polymer material. In an embodiment, the elastic synthetic polymer material may be nylon. A durable, long lasting synthetic polymer material should have sufficient strength to provide reliable support, but sufficient flexibility to enable assembly as just described above, as well as reliable breakaway performance in the event an object being carried using a clip assembly becomes caught or entangled while the clip assembly is being used. In summary, a novel clip piece as described herein, especially when a pair of clip pieces are used in face-to-face configuration in a clip assembly, provides the user with the benefit of a simple design which makes it unnecessary to have or stock numerous components to provide a reliable clip assembly, and which provides enhanced breakaway performance, especially when side loads are encountered by the clip assembly.

BRIEF DESCRIPTION OF THE DRAWING

The present invention(s) will be described by way of exemplary embodiments, using for illustration the accompanying drawing in which like reference numerals denote like elements, and in which:

FIGS. 7 through 12B provide views of an embodiment for a clip assembly, and also showing in some of those drawings the separation of the clip assembly into two clip pieces, and as illustrated, an embodiment where the clip pieces are identical.

FIG. 7 provides a side elevation view of two clip pieces, ready for being joined into a clip assembly, wherein two clip pieces are to be joined in a face-to-face releasably interlocking relationship, showing a near latch on each clip piece (a far latch on each clip piece is hidden behind the respective near latch), ready for being urged into a latch keep in the companion clip piece.

FIG. 8 provides a side elevation view of a clip assembly, where two clip pieces have been joined in a face-to-face releasably interlocking relationship, and where the distal end of a near latch on each clip piece (a far latch on each clip piece is hidden behind the respective near latch) is shown protruding through a latch keep in the companion clip piece FIG. 9 provides an end elevation view of two clip pieces, ready for being joined into a clip assembly, where the two clip pieces are to be joined in a face-to-face releasably interlocking relationship, showing a first latch and a second latch on a clip piece near the distal ends of its first outer prong and second outer prong, respectively, where the first latch and second latch are ready for being urged upward and displaced laterally inward during entry into a latch keep in the companion clip piece.

FIG. 10 provides an end elevation view of a clip assembly, made up of two clip pieces as just shown in FIG. 9, where the two clip pieces are now joined together in a face-to-face relationship into a clip assembly, showing a first latch and a second latch from the lower clip piece now secured an a releasable locked engagement configuration to an upper clip piece, and wherein the first latch and second latch have returned laterally outwardly into a locked position in the upper clip piece.

FIG. 11 provides an end elevation view of a clip assembly, made up of two clip pieces as just shown in FIG. 10, but now showing the two clip pieces joined at a distal end, yet hinged and disjoined at the proximal end and showing how the first outer prong and the second outer prong on the upper clip are in a normal position without external inward loading of the first and second outer prongs toward the central prong, and where the first latch on the first outer prong and the second latch on the second outer prong are disengaged from their respective latches.

FIG. 12B provides an end elevation view of a clip assembly, made up of two clip pieces as just shown in FIG. 12A, but now showing how the first outer prong and the second outer prong on the upper clip have been released, allowing the outwardly biased pressure of the first outer prong and the second outer prong to urge the first latch on the first outer prong and the second latch on the second outer prong to their secure, locked positions.

Figure 1:
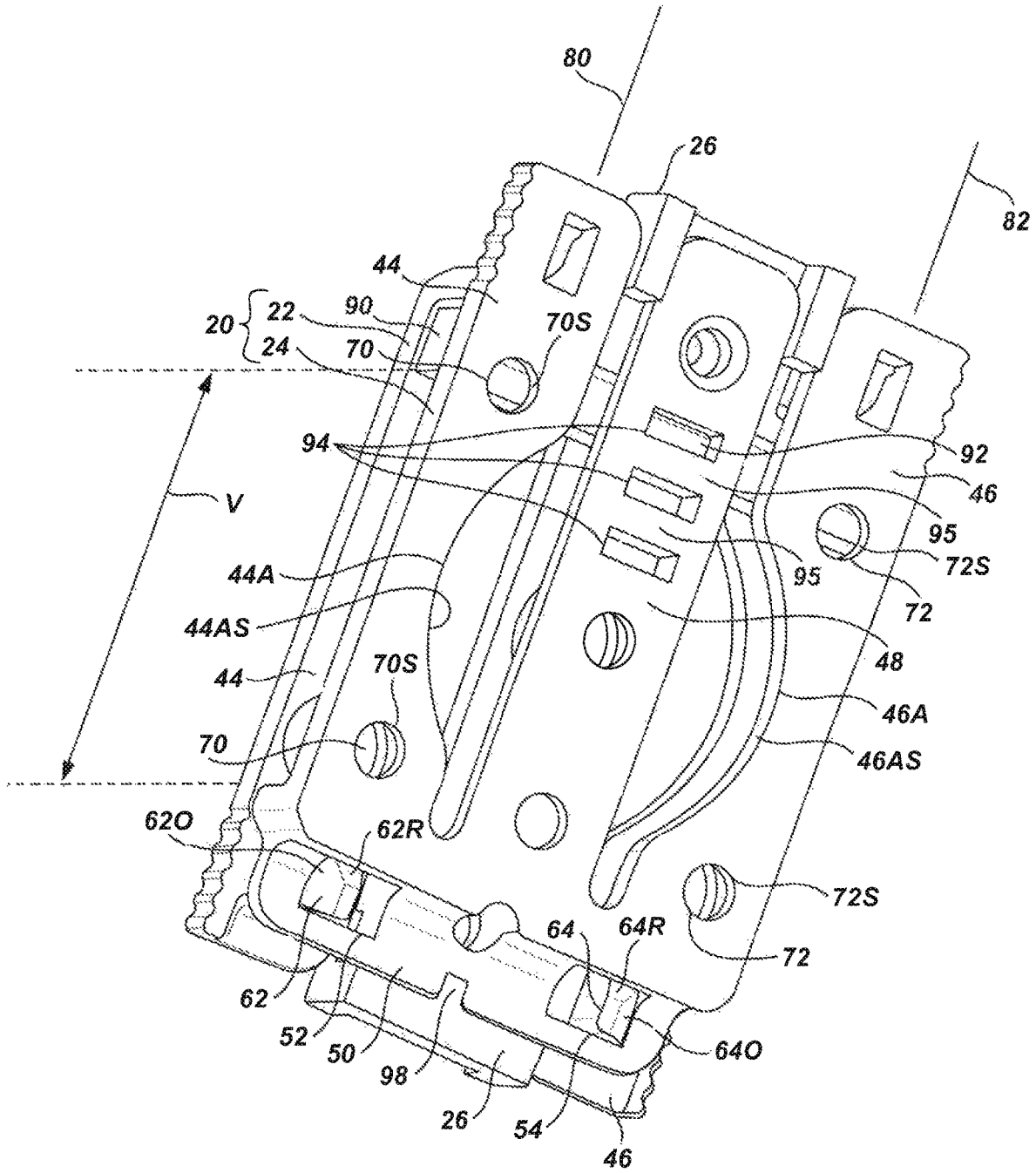
FIG. 1 is a perspective view of an embodiment for a clip assembly, showing a pair of novel clip pieces joined in a face-to-face working relationship to provide a multi-platform attachment assembly system, where a clip piece may include a first outer prong, a second outer prong, and at least one central prong, and wherein the first outer prong and the second outer prong both include, near the distal end thereof, a first latch and a second latch, respectively, and wherein each clip piece includes a latch keep for secure releasable engagement between the first latch and the latch keep of a companion clip piece, and between the second latch and the latch keep of a companion clip piece.

The foregoing figures, being merely exemplary, contain various elements that may be present or omitted from a final configuration for a clip assembly. Other variations in the construction of a clip piece may use different materials of construction, variations in structures, or configurations for the degree of stiffness or locking force between a first clip piece and a second clip piece, and yet employ the principles described herein and as generally depicted in the drawing figures provided. An attempt has been made to draw the figures in a way that illustrates at least those elements that are significant for an understanding of an exemplary clip assembly for use in attachment of objects to a user or to an object carried or worn by a user. Such details may be quite useful for providing a novel clip piece, and thus a novel clip assembly, for use with various substrates. Thus, it should be understood that various features may be utilized in accord with the teachings hereof, as may be useful in different clip piece for use with a clip assembly as may be useful for various sizes and shapes, depending upon specific design requirements, within the scope and coverage of the teachings herein as defined by the claims.

DETAILED DESCRIPTION

Attention is directed to FIG. 1, where a perspective view is provided to illustrate an embodiment for a clip assembly 20 which is provided by joining a first clip piece 22 and a second clip piece 24 in a face-to-face releasable but secure, joined relationship. Additionally, an optional pair of locking tabs 26 is provided to lock the first clip piece 22 and the second clip piece 24 together in a secure manner. Use of the locking tabs 26 enables a user to select a mode of operation wherein the feature of separation when excessive loads are applied, such as side loading on an externally mounted second clip piece 24, is no longer provided.

Figure 2:
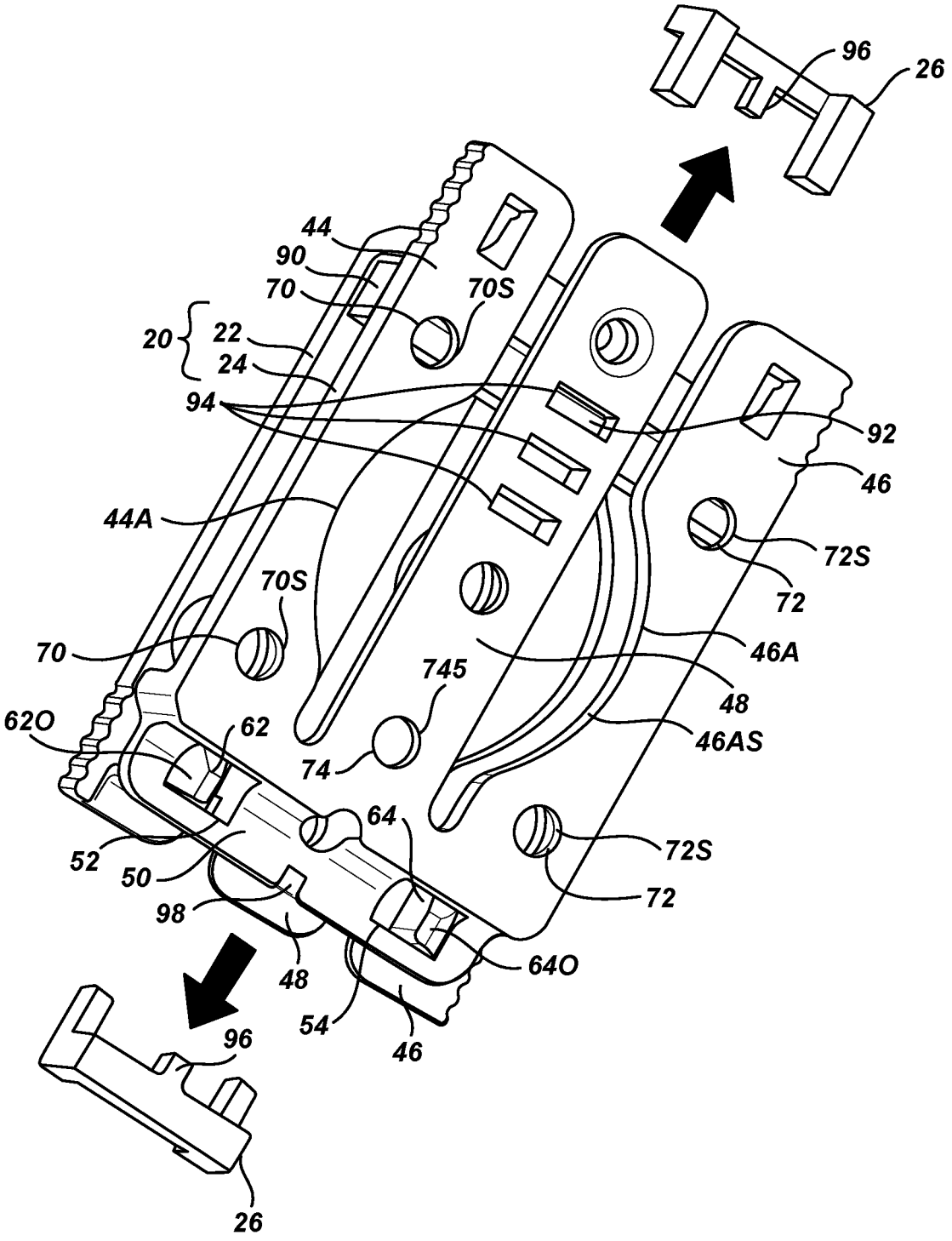
FIG. 2 is a perspective view of an embodiment for a clip assembly as just shown in FIG. 1 above, but additionally showing the use of a pair of removable locks, where the locks (shown securely fitted in FIG. 1) are now shown removed from the clip assembly; the locks may be especially useful when one or more spacers (one spacer is shown in FIG. 2) are utilized between a first clip and a second clip for decreasing the vertical dimension of the working area defined between first and second clips when securely joined in an operating configuration, where the working area is provided for accommodating user's belt or similar object for detachably securing the clip assembly thereto.
Figure 6:
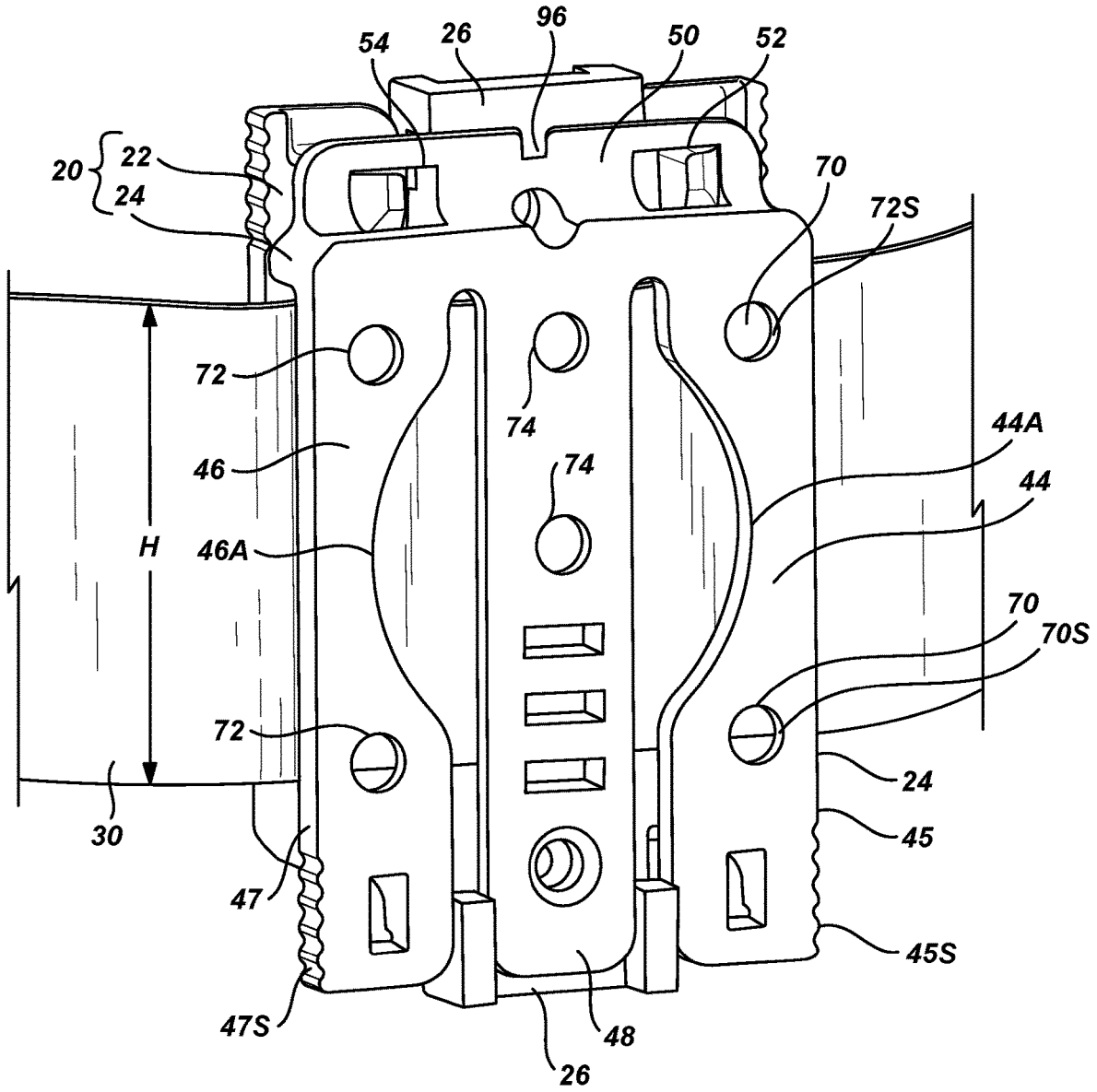
FIG. 6 is a perspective view of an embodiment for a clip assembly shown attached to a belt of a user, showing a pair of novel clip pieces joined in a face-to-face working relationship to provide a multi-platform attachment assembly system, where a clip piece may include a first outer prong, a second outer prong, and at least one central prong, and wherein the first outer prong and the second outer prong both include, near the distal end thereof, a first latch and a second latch, respectively, and wherein each clip piece includes a latch keep for secure releasable engagement between the first latch and the latch keep of a companion clip piece, and between the second latch and the latch keep of a companion clip piece.

As depicted in FIG. 2, the locking tabs 26 may be removed from the clip assembly 20, so that the joined first clip piece 22 and the second clip piece 24 may be separated, either manually or by external forces acting an externally mounted second clip piece 24 (see FIG. 6, where the second clip piece 24 is mounted externally to a user's belt 30).

Figure 4:
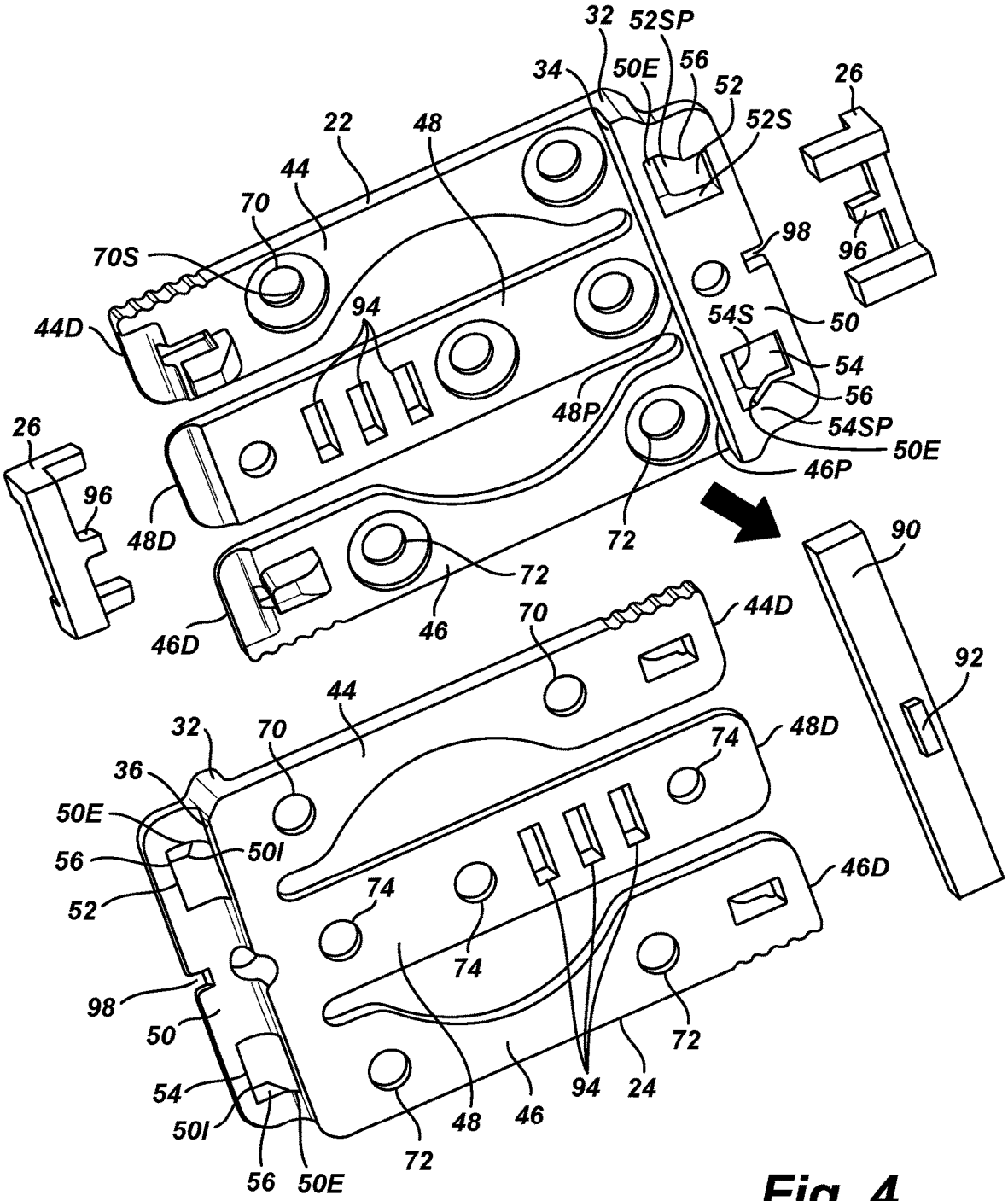
FIG. 4 is an exploded perspective view of an embodiment for a clip assembly as just shown in FIGS. 1, 2 and 3 above, but now showing a spacer removed from the working area between a first clip piece and a second clip piece which have been disjoined.

Attention is directed to the exploded perspective view of a clip assembly 20 shown FIG. 4, where further details of a first clip piece 22 and second clip piece 24 are visible. In an embodiment, a first 22 or second 24 clip piece may include a support bar 32, which in an embodiment may be integrally formed and provided as an element of first clip piece 22 or second clip piece 24. The support bar 32 may include an inner face 34, an outer face 36, and a laterally extending body 38 (See FIG. 9, 10, 11, or 12) between the inner face 34 and the outer face 36. The body 38 of the support bar 32 extends between a first body end 40 and a second body end 42.

In an embodiment, the first clip piece 22 and the second clip piece 24 may each include a first outer prong 44, a second outer prong 46, and at least one central prong 48. The at least one central prong 48 is spaced apart from and located between the first outer prong 44 and the second outer prong 46. In an embodiment, the first outer prong 44, the second outer prong 46, and the least one central prong 48 each have a proximal end (44P, 46P, and 48P, respectively, located at the support bar 32. The first outer prong 44, the second outer prong 46, and the at least one central prong 48 each extend longitudinally from their proximal ends (44P, 46P, and 48P, respectively) to a distal end, 44D, 46D, and 48D, respectively.

In each clip piece (22 and 24), a latch keep portion 50 is provided. The latch keep portion 50 may include an internal portion 501 and an external portion 50E. The internal portion 501 is configured for receiving a first latch 62 or a second latch 64 as further described below. In an embodiment, the latch keep portion 50 extends from the outer face 36 of the support bar 32. As better seen in FIGS. 3 and 4, the latch keep portion 50 further comprises a first latch keep aperture 52 defined by first latch keep inner sidewalls 52S, and a second latch keep aperture 54 defined by second latch keep inner sidewalls 54S. In an embodiment, the first latch keep inner sidewalls 52S and the second latch keep inner sidewalls 54S may include a laterally sloping portion 52SP and 54 SP, respectively. In an embodiment, the laterally sloping portions 52SP and 54SP form a wall portion of latching ledges 56. As seen in FIG. 4, latching ledges 56 are provided recessed inwardly from external portion 50E of latch keep portion 50, yet are located at a lateral wall 52L of the first latch keep aperture 52 and lateral wall 54L of the second latch keep aperture 54. In an embodiment, the latching ledges 56 may be provided having the shape of a right trapezoid.

Figure 11:
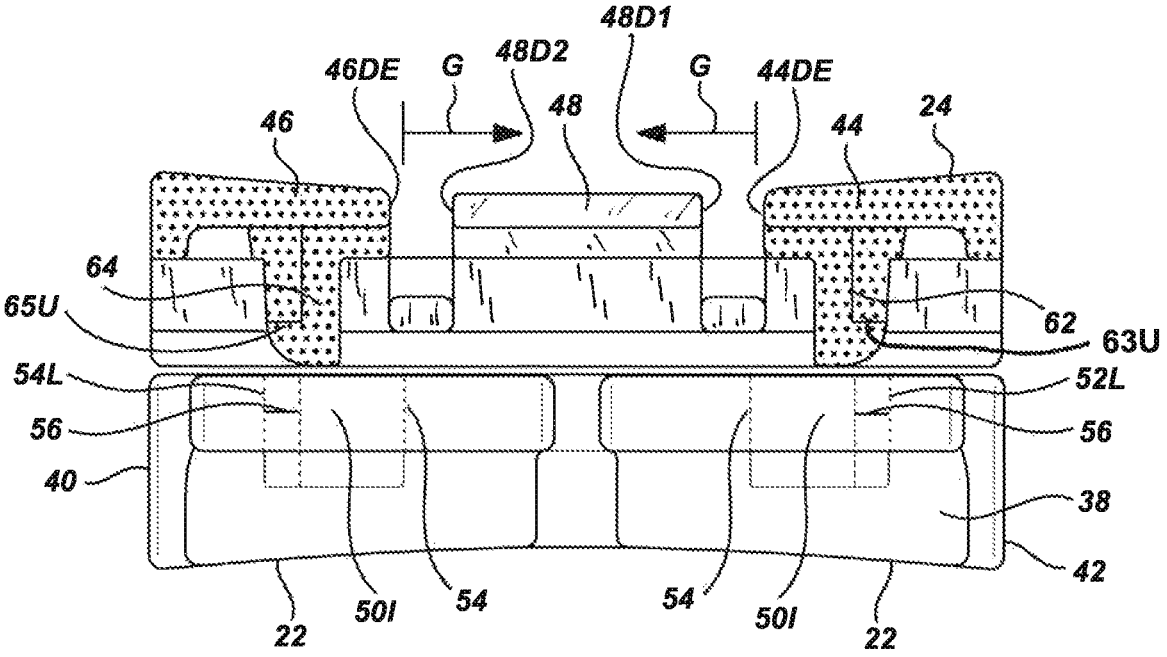

In an embodiment, a first latch 62 and a second latch 64 may be provided. In such a configuration, the first latch 62 may be located at, near, or toward the distal end 44D of the first outer prong 44. The first latch 62 is sized and shaped for interfitting, interlocking releasable engagement with the first latch keep inner sidewalls 52S of the first latch keep aperture 52. In an embodiment, a latch surface 65U on a J-shaped portion of first latch 62 may be configured for releasable interlocking engagement with a companion latching ledge 56, as seen in FIG. 11. A second latch 64 may be located at, near, or toward the distal end 46D of the second outer prong 46. The second latch 64 is sized and shaped for interfitting, interlocking releasable engagement with the second latch keep inner sidewalls 54S of the second latch keep aperture 54. Similarly, an embodiment, a latch surface 65U on a J-shaped portion of second latch 64 may be configured for releasable interlocking engagement with a companion latching ledge 56, also as seen in FIG. 11.

Figure 3:
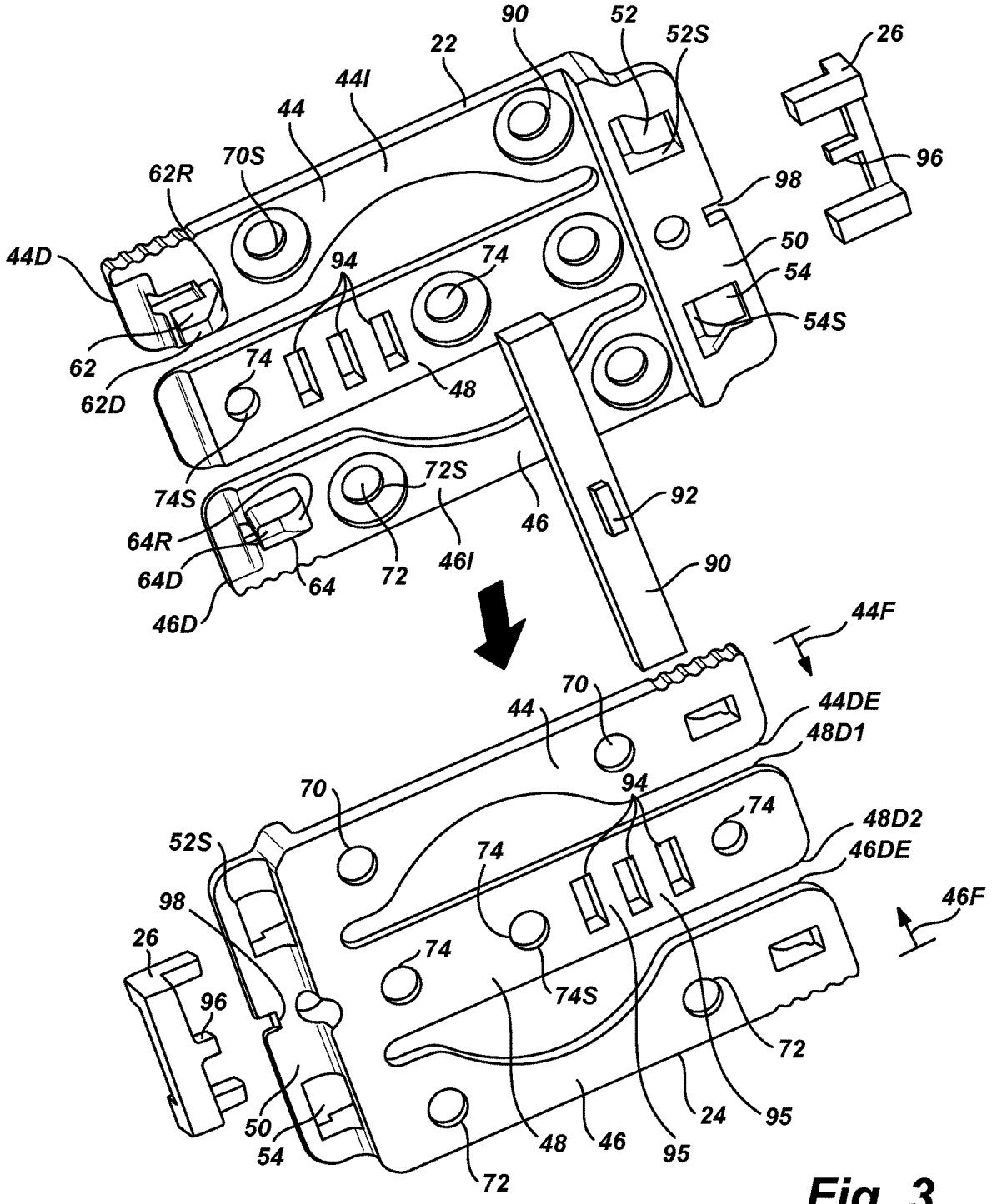
FIG. 3 is an exploded perspective view of an embodiment for a clip assembly as just shown in FIGS. 1 and 2 above, but now showing a first clip piece and a second clip piece which have been disjoined, as well as still showing the use of a pair of removable locks removed from the clip assembly, and the use of one or more spacers (one spacer is shown in FIG. 2) are utilized between a first clip and a second clip for decreasing the vertical dimension of the working area defined between first and second clips when securely joined in an operating configuration, where the working area is provided for accommodating user's belt or similar object for detachably securing the clip assembly thereto.
Figure 12A:
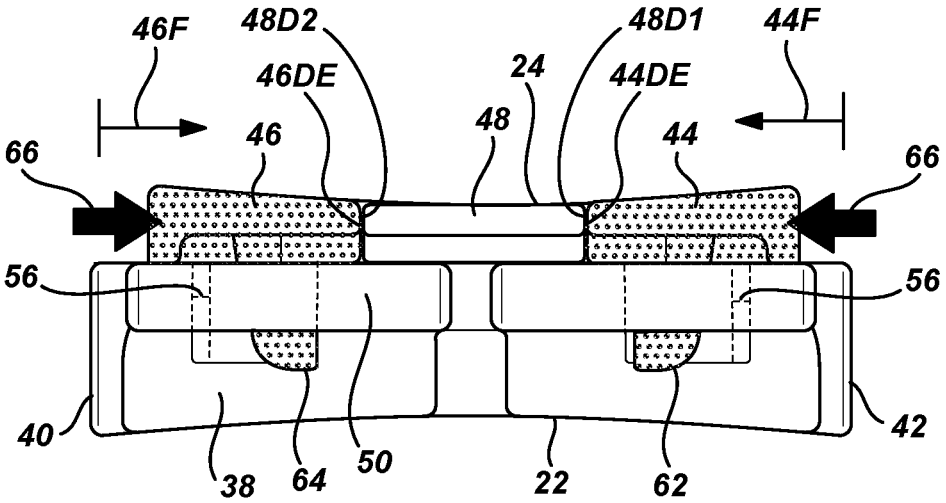
FIG. 12A provides an end elevation view of a clip assembly, made up of two clip pieces as just shown in FIG. 11, but now showing how the first outer prong and the second outer prong on the upper clip have been urged inward in the direction of the reference arrows, to contact edges of the central prong, which has allowed the first outer prong and the second outer prong on the upper clip to fit downward into their respective latches, but since the inward pressure as noted by the arrows is being maintained in this FIG. 12A, the first latch on the first outer prong and the second latch on the second outer prong have not engaged their respective latches in a locked configuration.
Figure 12B:
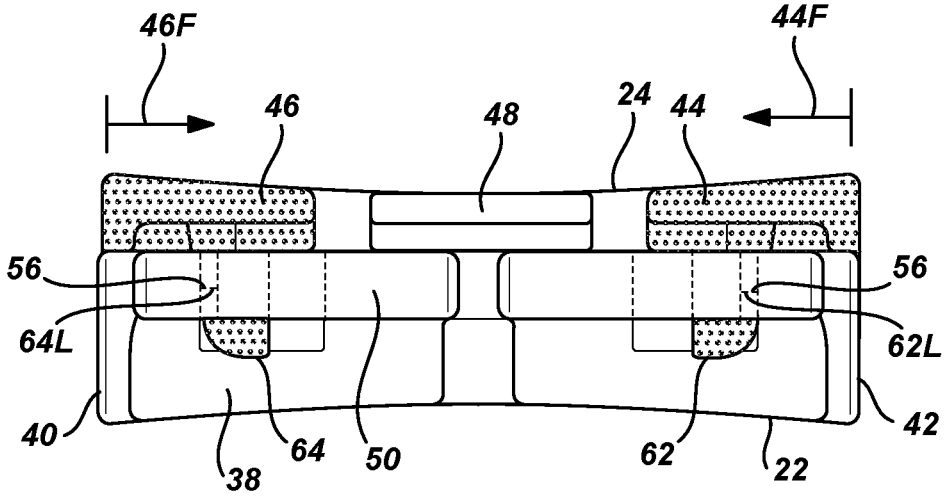

In an embodiment, the first outer prong 44 and the second outer prong 46 are each flexible, so that distal end 44D of the first outer prong 44 and the distal end 46D of the second outer prong 46 can each be urged toward the at least one central prong 48, as indicated by reference arrows 44F and 46F in FIG. 3. As seen in FIG. 11, in an embodiment, the gap G between the first outer prong 44 and the at least one central prong 48 may be closed so that the first outer prong 44 and the at least one central prong 48 touch. Likewise, in an embodiment, the gap G between the second outer prong 46 and the at least one central prong 48 may be closed so that the second outer prong 46 and the at least one central prong 48 touch. In an embodiment, the distal end 44D of the first outer prong 44 has an inner edge 44DE, which can be urged to touch a first outer edge 48D1 of the at least one central prong 48. In an embodiment, the distal end 46D of the second outer prong 46 has an inner edge 46DE which can be urged to touch a second outer edge 48D2 of the at least one central prong 48. See reference arrows 66 in FIG. 12A, which show how inward pressure urges the first outer prong 44 and the second outer prong 46 inward toward the at least one central prong 48. FIG. 12B shows an end elevation view of a clip assembly, made up of two clip pieces (first clip piece 22 and a second clip piece 24) in a face-to-face, locked relationship, where outwardly biased pressure (inherent in structure and materials selected) of the first outer prong and the second outer prong urge the first latch on the first outer prong and the second latch on the second outer prong to their secure, locked positions, where latch surface 63U on a J-shaped portion of first latch 62, and latch surface 65U on a J-shaped portion of second latch 64 interact to provide locking engagement between the illustrated end of the first clip 22 and the second clip 44.

As seen in FIG. 3, in an embodiment, the first outer prong 44 has a first inside surface 441. In an embodiment, the first latch 62 protrudes outward away from the first inside surface 441. Likewise, the second outer prong 46 has a second inside surface 461, and the second latch 64 protrudes outward away from the second inside surface 461. The first latch 62 and the second latch 64 both protrude inwardly with respect to a clip assembly, for detachable interlocking engagement.

In an embodiment, the latch keep portion 50 may extend from the support bar 32 in a direction opposite the proximal end 44P of the first outer prong 44 and in a direction opposite the proximal end 46P of the second outer prong 46.

In an embodiment, the first outer prong 44 further includes, between its proximal end 44P and its distal end 44D, a first arch shaped cutaway portion 44A defined by a first arch surface 44AS, and wherein the first arch surface 44AS faces toward the at least one central prong 48. Likewise, in an embodiment, the second outer prong 46 may further comprise, between its proximal end 46P and its distal end 46D, a second arch shaped cutaway portion 46A defined by a second arch surface 46AS, and wherein the second arch surface 46AS faces toward the at least one central prong 48. The arch cutaway portions 44A and 46A provide for increased flexibility of the first outer prong 44 and the second outer prong 46, respectively, to be urged together as indicated by reference arrows 44F and 46F.

In an embodiment, the first outer prong 44 further includes, between its proximal end 44P and its distal end 44D, one or more apertures 70 therein, each defined by aperture sidewalls 70S. Similarly, the second outer prong 46 further includes, between its proximal end 46P and its distal end 46D, one or more apertures 72 therein, each defined by aperture sidewalls 72S. Additionally, in an embodiment, the at least one central prong 48 may further include, between its proximal end 48P and its distal end 48D, one or more apertures 74 therein, each defined by aperture sidewalls 74S.

As seen in FIG. 6, in an embodiment, the first outer prong 44 further includes a first outside edge 45, and the first outside edge 45 further includes a serrated grip portion 45S adjacent the distal end 44D of the first outer prong 44. Likewise, in an embodiment, the second outer prong 46 further comprises a second outside edge 47, and the second outside edge 47 further includes a serrated grip portion 47S adjacent the distal end 46D of the second outer prong 46.

As noted above, and as seen in FIG. 4, in an embodiment, latching ledges 56 may be provided having the shape of a right trapezoid. In an embodiment, the first latch keep inner sidewalls 52S may include a laterally sloping portion 52SP that forms a wall portion of latching ledge 56. In an embodiment, a first latching ledge 56 may be sized and shaped for releasable engagement with a first selected latch 62. In an embodiment, the second latch keep inner sidewalls 54S may include a laterally sloping portion 54SP that forms a wall portion of latching ledge 56. In an embodiment, a second latching ledge 56 may be sized and shaped for releasable engagement with a second selected latch 64.

Figure 9:
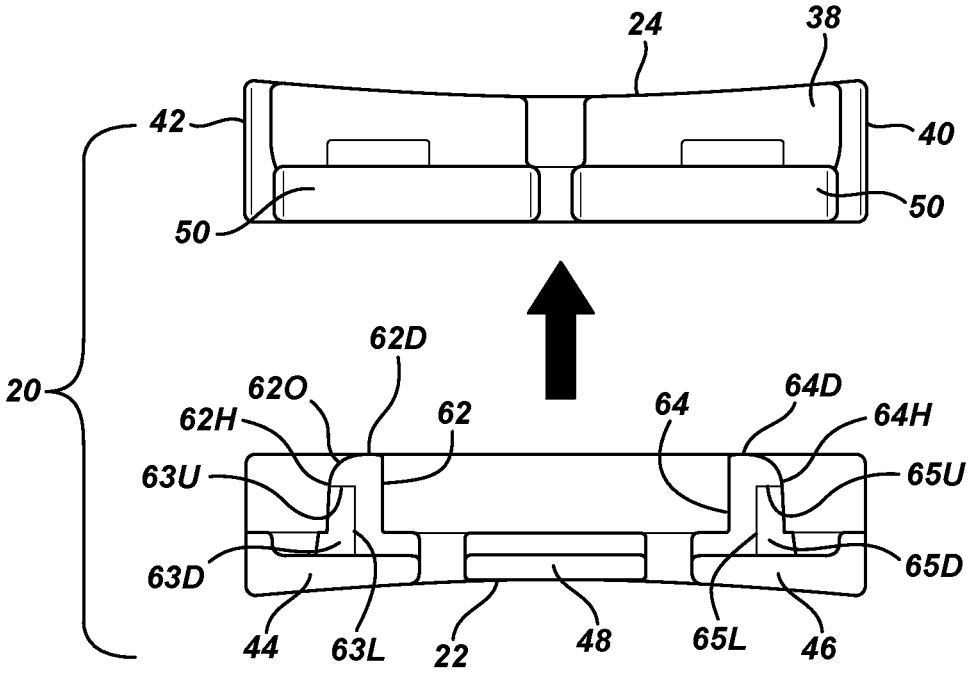
Figure 10:
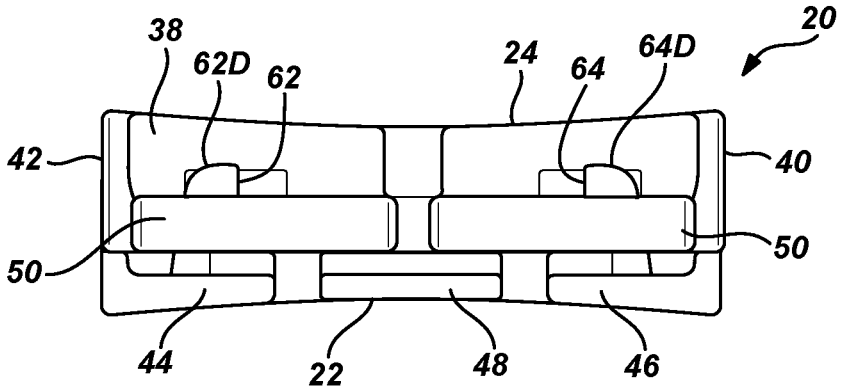

Attention is directed to FIG. 9, where an end view of first latch 62 and second latch 64 is provided. The first latch 62 may have a generally J-shaped structure having a hooked end 62H. In an embodiment, the hooked end 62H is open in a direction away from the at least one central prong 48, as provided by outwardly oriented (from the at least one central prong 48) wall 63L, the distally oriented wall 63D, and a downwardly oriented latching upper wall having a latch surface 63U. The second latch 64 may have a generally J-shaped structure having a hooked end 64H. In an embodiment, the hooked end 64H is open in a direction away from the at least one central prong 48, as provided by outwardly oriented (from the at least one central prong 48) wall 65L, the distally oriented wall 65D, and a downwardly oriented latching upper wall having a latch surface 65U.

In an embodiment, the generally J-shaped structure of first latch 62 may have a rear portion 62R, in which the rear portion 62R is rounded downward toward the proximal end 44P of the first outer prong 44. In an embodiment, the generally J-shaped structure of second latch 64 may have a rear portion 64R, in which the rear portion 64R is rounded downward toward the proximal end 46P of the second outer prong 46. The just mentioned structures of first latch 62 may more clearly appreciated as mirror images of the structures of second latch 64 identified in FIG. 7, although such elements are pointed out in other drawing figures.

In an embodiment, the generally J-shaped structure of first latch 62 includes a distal end 62D at the bottom of the J-shaped structure. In an embodiment, the generally J-shaped structure of first latch 62 may have a rounded outward surface 620 (which may be in a direction transverse to the longitudinal axis 80 of first outer prong 44) from the distal end 62D to the hooked end 62H. In an embodiment, the generally J-shaped structure of second latch 64 includes a distal end 64D at the bottom of the J-shaped structure. In an embodiment, the generally J-shaped structure of second latch 64 may have a rounded outward surface 640 (which may be in a direction transverse to the longitudinal axis 82 of second outer prong 46) from the distal end 64D to the hooked end 64H.

As seen in FIG. 6, as well as from various other figures of the drawing, a first clip piece 22 and a second clip piece 24 may be releasably joined in an interlocking but detachable relationship to provide a clip assembly 20. In an embodiment, the first clip piece 22 and the second clip piece 24 may be identical, which greatly simplifies inventory and parts stocking issues in providing a device for use in a multi-platform attachment system. In an embodiment, the first clip piece may be provided using a nylon polymer. In an embodiment, the second clip piece may be provided using a nylon polymer.

In an embodiment, the first clip piece 22 and the second clip piece 24 in a clip assembly are detachable when using a removal force that pulls the first latch 62 in the first clip piece 22 from the first latch keep aperture 52 in the second clip piece 24, and that pulls the second latch 64 in the first clip piece 22 from the second latch keep aperture 54 in the second clip piece 24. In an embodiment, the first clip piece 22 and the second clip piece 24 are detachable when using a removal force that pulls the first latch 62 in the second clip piece 24 from the first latch keep aperture 52 in the first clip piece 22, and that pulls the second latch 64 in the second clip piece 24 from the second latch keep aperture in the first clip piece 22. In normal use, a first clip piece 22 and a second clip piece 24 can be disengaged in at least two ways. First, by pressing the first outer prong 44 and the second outer prong 46 toward the at least one central prong 48 in each one of the first clip piece 22 and second clip piece 24, all four latches (62 and 64, in each clip piece) are disengaged (i.e. by squeezing all four corners of a clip assembly 20). More easily, perhaps, the first outer prong 44 and the second outer prong 46 in a first clip piece (only) may be squeezed toward the at least one central prong 48 in a clip piece (22 or 24), to disengage the latch (62 and 64) from an opposing clip piece, and then the clip assembly 20 is pivoted open at the other end, as depicted in FIG. 11.

Figure 5:
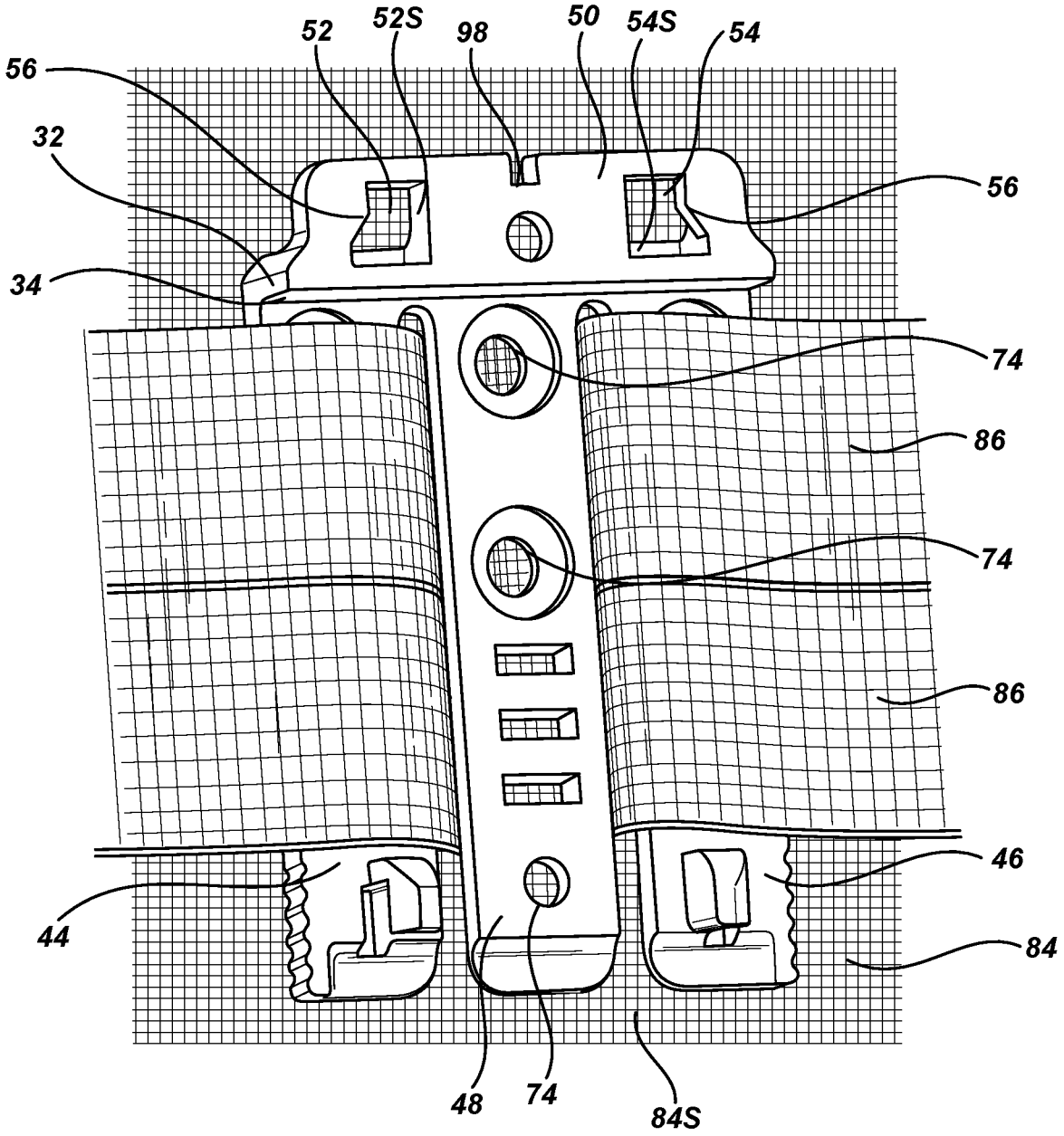
FIG. 5 is a perspective view of a clip piece located on and attached to an article that is using a pouch attachment ladder system ("PALS") webbing grid; a PALS webbing grid is taught by U.S. Pat. No. 5,724,707 issued Mar. 10, 1998 to Kirk et. al and assigned to the United States Army, and such PALS webbing grids may be found on various configurations of modular lightweight loadbearing equipment ("MOLLE").

Attention is directed to FIG. 5, where a perspective view of a first clip piece 22 is shown located on and attached to an equipment article 84 that is using a pouch attachment ladder system ("PALS") webbing grid 86. The first clip piece 22 is ready for receiving a second clip piece 24, and when that is completed, a clip assembly 20 will be provided. In this type of application the first outer prong 44 and the second outer prong 46 may be fitted over the surface 84S of equipment article 84, but under the webbing grid 86, and in such manner, the first clip 22 is securely affixed to the equipment article 84. The PALS type webbing grid 86 is taught by U.S. Pat. No. 5,724,707 issued Mar. 10, 1998 to Kirk et. al and assigned to the United States Army. Such PALS webbing grids 86 may be found on various configurations of modular lightweight loadbearing equipment ("MOLLE").

Figure 7:
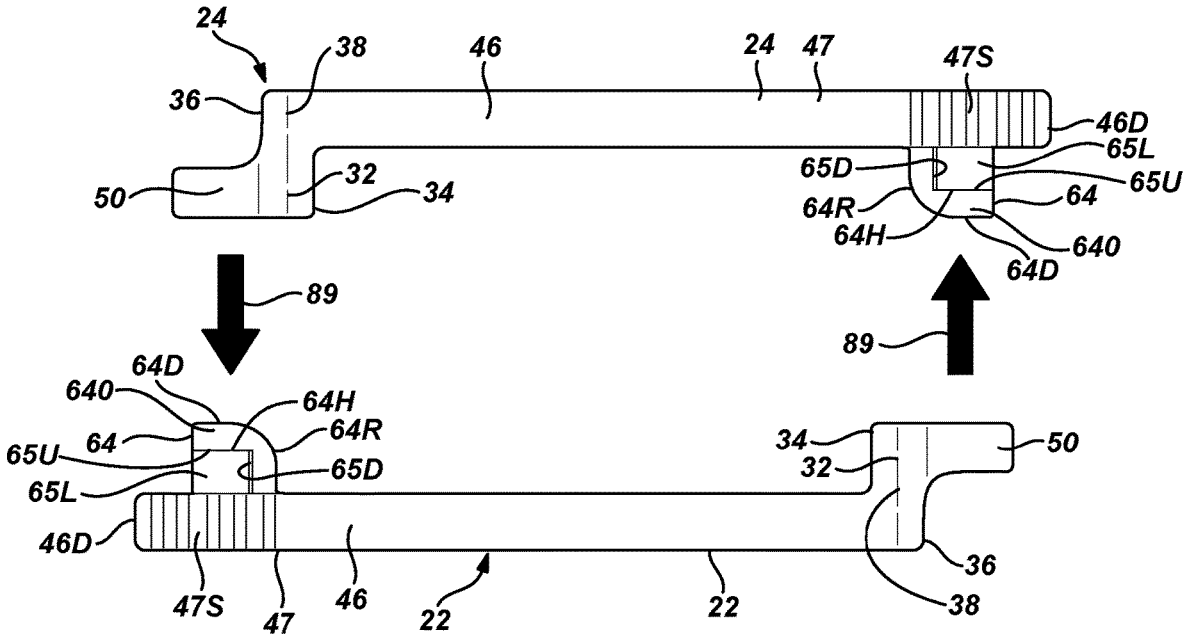
Figure 8:
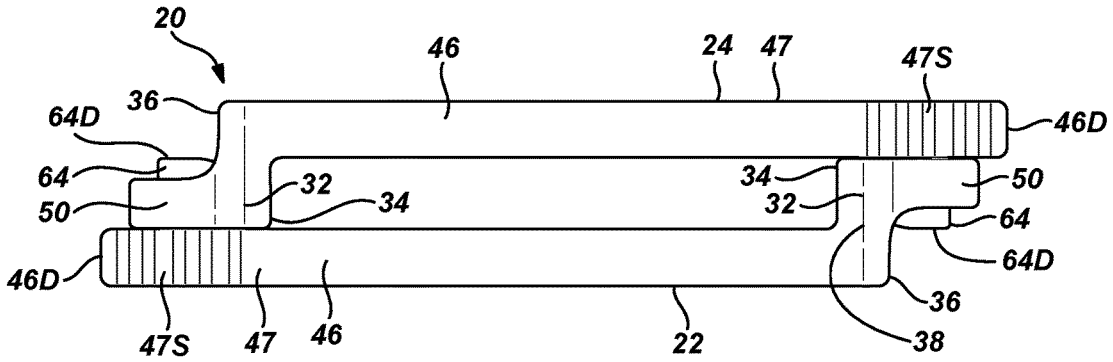

As can be appreciated from FIGS. 7 and 8, a first clip piece 22 as just shown in FIG. 5, can be used in a clip assembly 20. As seen in FIG. 7, a first clip piece 22 and a second clip piece 24 may be joined in a face-to-face releasably interlocking relationship, by moving the first clip piece 22 and the second clip piece 24 together in the direction of reference arrows 89.

As seen in FIGS. 1 through 4, in an embodiment, at least one spacer bar 90 may be provided, in order to more closely provide a vertical distance V (see FIG. 1) to closely accommodate the height H of a user's belt 30, as seen in FIG. 6 (where no spacer bar 90 is provided). In an embodiment, as seen in FIG. 4, each of the at least one spacer bars 90, may include a spacer bar tab 92 that is sized and shaped for compatible fitting or mating engagement in one of the through hole recesses 94 in the at least one central prong 48. Strengthening bridges 95 may be provided between recesses 94. In an embodiment, the spacer bar tab 92 and a recess 94 in the at least one central prong 48 may each be generally rectangular in shape, or in the case of the spacer bar tab 92, generally parallelepiped in shape.

In various embodiments, a clip assembly 20 may further include a lock 26. A lock 26 may be provided in a generally L-shaped configuration having a centrally located locking tab 96. In such a configuration, the latch keep portion 50 of the first clip piece 22 and the latch keep portion 50 of the second clip piece 24 each further comprise a locking tab receiver 98. When such a configuration is utilized, a clip assembly 20 may further include at least one L-shaped lock 26 detachably secured locking tab in a clip assembly 20. Preferably, when locking action is desired, then two locks 26 are provided, one lock 26 at the distal end 48D of the at least one central prong 48 of the first clip piece 22, and a second lock 26 at the distal end 48D of the at least one central prong 48 of the second clip piece 24.

As noted above, a first clip piece 22 and a second clip piece 24 may be provided with identical features and manufactured with identical materials. This allows for reduced manufacturing costs, and it allows for repair by simply replacing a single damaged part. Such a unique multi-platform attachment system ("M-PAS") can be quickly and easily installed on pouches, packs, vests, and other objects or panels, to enable a user to quickly reconfigure gear as appropriate for tasks ahead. For example, if a first aid kit is installed on a vest or backpack, the first aid kit can be quickly transferred from vest to pack, or from pack to vest, as needs dictate.

In the foregoing description, for purposes of explanation, numerous details have been set forth in order to provide a thorough understanding of the disclosed exemplary embodiments for the design of a clip piece suitable for being used in a clip assembly for securing objects to a selected substrate, such as a pack or a belt, which may include a PALS type attachment webbing. However, certain of the described details may not be required in order to provide useful embodiments, or to practice selected or other disclosed embodiments. Further, for descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in any method described herein may have been described as multiple discrete activities, in turn, in a manner that is most helpful in understanding the present invention. However, the order of description should not be construed as to imply that such activities are necessarily order dependent. In particular, certain operations may not necessarily need to be performed precisely in the order of presentation. And, in different embodiments of the invention, one or more structures may be simultaneously provided, or eliminated in part or in whole while other elements may be added. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, unless the context dictates otherwise.

It will be understood by persons skilled in the art that embodiments for configurations of clip pieces have been described herein only to an extent appropriate for such skilled persons to make and use such clip pieces in a useful clip assembly. Additional details may be worked out by those of skill in the art for a selected set of specifications, useful life, materials of construction, and other design criteria, such as the amount of force, or the direction of forces necessary to detach one clip piece from the other.

Importantly, the aspects and embodiments described and claimed herein may be modified from those shown without materially departing from the novel teachings and advantages provided, and may be embodied in other specific forms without departing from the spirit or essential characteristics thereof. Therefore, the embodiments presented herein are to be considered in all respects as illustrative and not restrictive or limiting. As such, this disclosure is intended to cover the structures described herein and not only structural equivalents thereof, but also equivalent structures.

Although only certain specific embodiments of the present invention have been shown and described, the invention is not limited to such embodiments. Rather, the invention is to be defined by the appended claims and their equivalents when taken in combination with the description. Numerous modifications and variations are possible in light of the above teachings. Therefore, the protection afforded to this invention should be limited only by the claims set forth herein, and the legal equivalents thereof.

The invention claimed is:

1. A clip piece for use in a clip assembly for attachment of an object to a user, comprising:

a support bar, the support bar having an inner face, an outer face, and a body between the inner face and the outer face, the body extending between a first end and a second end;

a first outer prong, a second outer prong, and at least one central prong, the at least one central prong spaced apart from and located between the first outer prong and the second outer prong, wherein the first outer prong, the second outer prong, and the at least one central prong each have a proximal end located at the support bar, and each of the first outer prong, the second outer prong, and the at least one central prong extend longitudinally from the proximal end to a distal end;

a latch keep portion, the latch keep portion extending from the outer face of the support bar, wherein the latch keep portion further comprises a first latch keep aperture defined by first latch keep inner sidewalls, and a second latch keep aperture defined by second latch keep inner sidewalls;

a first latch, the first latch located adjacent the distal end of the first outer prong, the first latch sized and shaped for interfitting releasable engagement with the first latch keep aperture;

a second latch, the second latch located adjacent the distal end of the second outer prong, the second latch sized and shaped for interfitting releasable engagement with the second latch keep aperture;

wherein the first outer prong and the second outer prong are flexible, so that the distal end of the first outer prong and the distal end of the second outer prong can each be urged toward the at least one central prong; and wherein the clip piece is sized and shaped for secure interlocking and detachable engagement with an identical clip piece.

2. The clip piece as set forth in claim 1, wherein the first latch is sized and shaped for interfitting releasable engagement with the first latch keep inner sidewalls of the first latch keep aperture.

3. The clip piece as set forth in claim 1, wherein the second latch is sized and shaped for interfitting releasable engagement with the second latch keep inner sidewalls of the second latch keep aperture.

4. The clip piece as set forth in claim 1, wherein the first outer prong has a first inside surface, and wherein the first latch protrudes outward away from the first inside surface.

5. The clip piece as set forth in claim 1, wherein the second outer prong has a second inside surface, and wherein the second latch protrudes outward, away from the second inside surface.

6. The clip piece as set forth in claim 1, wherein the latch keep portion extends from the support bar in a direction opposite the proximal end of the first outer prong and the proximal end of the second outer prong.

7. The clip piece as set forth in claim 1, wherein the first outer prong further comprises, between the proximal end and the distal end, a first arch shaped cutaway portion defined by a first arch surface, and wherein the first arch surface faces toward the at least one central prong.

8. The clip piece as set forth in claim 1, wherein the second outer prong further comprises, between the proximal end and the distal end, a second arch shaped cutaway portion defined by a second arch surface, and wherein the second arch surface faces toward the at least one central prong.

9. The clip piece as set forth in claim 1, wherein the first outer prong further comprises, between the proximal end and the distal end, one or more apertures therein, each defined by aperture sidewalls.

10. The clip piece as set forth in claim 1, wherein the second outer prong further comprises, between the proximal end and the distal end, one or more apertures therein, each defined by aperture sidewalls.

11. The clip piece as set forth in claim 1, wherein each of the at least one central prong further comprises, between the proximal end and the distal end, one or more apertures therein, each defined by aperture sidewalls.

12. The clip piece as set forth in claim 1, wherein the first outer prong further comprises a first outside edge, and wherein the first outside edge includes a serrated grip portion adjacent the distal end of the first outer prong.

13. The clip piece as set forth in claim 1, wherein the second outer prong further comprises a second outside edge, and wherein the second outside edge includes a serrated grip portion adjacent the distal end of the second outer prong.

14. The clip piece as set forth in claim 1, wherein the first latch keep inner sidewalls, further comprises a first latching ledge, and wherein the first latching ledge is sized and shaped for releasable engagement with a first selected latch.

15. The clip piece as set forth in claim 1, wherein the second latch keep inner sidewalls, further comprises a second latching ledge, and wherein the second latching ledge is sized and shaped for releasable engagement with a second selected latch.

16. The clip piece as set forth in claim 1, wherein the first latch comprises a J-shaped structure having a hooked end, and wherein the hooked end is open in a direction away from the at least one central prong.

17. The clip piece as set forth in claim 16, wherein the J-shaped structure has a distal end, and wherein the J-shaped structure is rounded from the distal end to the hooked end.

18. The clip piece as set forth in claim 17, wherein the J-shaped structure further comprises a rear portion, and wherein the rear portion is rounded downward toward the proximal end of the first outer prong.

19. The clip piece as set forth in claim 1, wherein the second latch comprises a J-shaped structure having a hooked end, and wherein the hooked end is open in a direction away from the at least one central prong.

20. The clip piece as set forth in claim 19, wherein the J-shaped structure has a distal end, and wherein the J-shaped structure is rounded from the distal end to the hooked end.

21. The clip piece as set forth in claim 20, wherein the J-shaped structure further comprises a rear portion, and wherein the rear portion is rounded downward toward the proximal end of the second outer prong.

22. The clip piece as set forth in claim 1, wherein the at least one central prong further comprises a plurality of through hole recesses defined by recess interior walls, the through hole recesses being spaced apart longitudinally by strengthening bridges, and wherein the through hole recesses are sized and shaped therein to receive a locating tab having a compatible size and shape.

23. The clip piece as set forth in claim 22, further comprising at least one spacer bar, the at least one spacer bar comprising a spacer bar tab sized and shaped for compatible fitting engagement in one of the through hole recesses in the at least one central prong.

24. A clip assembly, comprising:

a first clip piece and a second clip piece as set forth in claim 1, the first clip piece and the second clip piece are detachably joined in an interlocked configuration.

25. The clip assembly as set forth in claim 24, wherein the first clip piece and the second clip piece are identical.

26. The clip assembly as set forth in claim 24, wherein the first clip piece and the second clip piece are detachable when using a removal force that pulls the first latch in the first clip piece from the first latch keep aperture in the second clip piece, and that pulls the second latch in the first clip piece from the second latch keep aperture in the second clip piece.

27. The clip assembly as set forth in claim 26, wherein the first clip piece and the second clip piece are detachable when using a removal force that pulls the first latch in the second clip piece from the first latch keep aperture in the first clip piece, and that pulls the second latch in the second clip piece from the second latch keep aperture in the first clip piece.

28. The clip assembly as set forth in claim 24, wherein the first clip piece and the second clip piece comprise nylon.

29. The clip assembly as set forth in claim 24, further comprising an L-shaped lock having a centrally located locking tab, and wherein the latch keep portion of the first clip piece and the latch keep portion of the second clip piece each further comprise a locking tab receiver, and wherein the L-shaped lock is detachably secured at the centrally located locking tab in at least one of the first clip piece and the second clip piece of the clip assembly.

30. A clip assembly, comprising:

a first clip piece and a second clip piece as set forth in claim 1, wherein the first clip piece and the second clip piece are detachably joined in an interlocked configuration;

the first latch of the first clip piece and the first latch of the second clip piece are sized and shaped for interfitting releasable engagement with the first latch keep inner sidewalls of the first latch keep aperture;

the second latch of the first clip piece and the second latch of the second clip piece are sized and shaped for interfitting releasable engagement with the second latch keep inner sidewalls of the second latch keep aperture;

the first outer prong of the first clip piece and of the second clip piece each have a first inside surface, and wherein the first latch protrudes outward away from the first inside surface;

the second outer prong of the first clip piece and of the second clip piece have a second inside surface, and wherein the second latch protrudes outward away from the second inside surface;

the first latch keep inner sidewalls of the first latch keep aperture of the first clip piece, and the first latch keep inner sidewalls of the first latch keep aperture of the second clip piece, each further comprises a first latching ledge, and wherein the first latching ledge is sized and shaped for releasable engagement with the first latch of the opposing clip piece; and the second latch keep inner sidewalls of the second latch keep aperture in the first clip piece, and the second latch keep inner sidewalls of the second latch keep aperture of the second clip piece, each further comprise a second latching ledge, and wherein the second latching ledge is sized and shaped for releasable engagement with the second latch of the opposing clip piece.

31. The clip assembly as set forth in claim 30, wherein the first latch in the first clip piece and in the second clip piece each comprises a J-shaped structure having a hooked end, and wherein the hooked end is open in a direction away from the at least one central prong.

32. The clip assembly as set forth in claim 31, wherein the second latch in the first clip piece and in the second clip piece each comprises a J-shaped structure having a hooked end, and wherein the hooked end is open in a direction away from the at least one central prong.

33. The clip assembly as set forth in claim 32, wherein the J-shaped structure further comprises a rear portion, and wherein the rear portion is rounded downward toward the proximal end of the second outer prong.

34. The clip assembly as set forth in claim 31, wherein the J-shaped structure further comprises a rear portion, and wherein the rear portion is rounded downward toward the proximal end of the first outer prong.

35. A clip assembly as set forth in claim 31, wherein the clip assembly provides an aperture between the first clip piece and the second clip piece, and wherein the aperture is sized and shaped for passage therethrough of a selected belt or strap.

36. The clip assembly as set forth in claim 31, wherein the clip assembly consists of the first clip piece having the first outer prong and the second outer prong, and wherein the second clip piece consists of the first outer prong and the second outer prong.

* * * * *